US005779099A

United States Patent [19]

D'Andrade

[11] Patent Number: 5,779,099

[45] Date of Patent: Jul. 14, 1998

[54] NOZZLE WITH TURBULENCE CONTROL MEMBER FOR WATER GUN LAMINAR FLOW EJECTION

[76] Inventor: Bruce M. D'Andrade, 3 Ten Eyck Rd., Whitehouse Station, N.J. 08889

[21] Appl. No.: 672,933

[22] Filed: Jun. 28, 1996

[51] Int. Cl.[6] ..... B05B 1/14

[52] U.S. Cl. ..... 222/79; 239/553.3; 239/553.5; 239/590.3; 239/590.5

[58] Field of Search ..... 222/79, 401; 464/405, 464/473; 239/553, 553.3, 553.5, 590, 590.3, 590.5

[56] References Cited

U.S. PATENT DOCUMENTS

| | | | |
|---|---|---|---|
| 2,627,439 | 2/1953 | Wornall | 239/590.5 |
| 2,820,675 | 1/1958 | Zilk | 239/553.3 |
| 2,962,226 | 11/1960 | Goodrie | 239/553.3 |
| 3,105,641 | 10/1963 | Curcio | 239/590.3 |
| 3,321,140 | 5/1967 | Parkison et al. | 239/553.5 |
| 3,420,447 | 1/1969 | Howard | 239/553.3 |
| 3,630,444 | 12/1971 | Nelson | 239/590.5 |
| 4,393,991 | 7/1983 | Jeffras et al. | 239/590.5 |
| 4,657,186 | 4/1987 | Shapiro | 239/590.3 |
| 4,730,786 | 3/1988 | Nelson | 239/590.5 |
| 4,735,239 | 4/1988 | Salmon et al. . | |
| 4,854,480 | 8/1989 | Shindo | 222/79 |
| 5,074,437 | 12/1991 | D'Andrade et al. . | |
| 5,242,119 | 9/1993 | Jariyasunant | 239/590.3 |
| 5,322,191 | 6/1994 | Johnson et al. . | |
| 5,472,145 | 12/1995 | Shannon et al. | 239/553.3 |
| 5,529,525 | 6/1996 | Deal . | |
| 5,558,278 | 9/1996 | Gallorini | 239/553.5 |

FOREIGN PATENT DOCUMENTS

| | | | |
|---|---|---|---|
| 496231 | 11/1938 | United Kingdom | 239/553.5 |

*Primary Examiner*—J. Casimer Jacyna
*Attorney, Agent, or Firm*—Kenneth P. Glynn, Esq.

[57] ABSTRACT

In a toy water gun having a barrel and a water ejection nozzle connected to an end of the barrel, wherein the nozzle has an ejection orifice of a predetermined diameter, there is included in the barrel a turbulence control member in proximity to the nozzle. This is for enhanced laminar flow ejection through the nozzle. The turbulence control member has a plurality of linear stream guidance walls. In some embodiments, optional screen(s) are included which are located contiguous to an end or both ends of the turbulence control member.

12 Claims, 2 Drawing Sheets

NOZZLE WITH TURBULENCE CONTROL MEMBER FOR WATER GUN LAMINAR FLOW EJECTION

BACKGROUND OF THE INVENTION

1. Field of the Invention

The present invention is directed to water guns, and more specifically, to devices for achieving more even, consistent flow of ejected water by reduction of turbulence in the barrel of the water gun within proximity of the ejection nozzle.

2. Information Disclosure Statement

Water guns have been around for many decades. Most water guns involve simple trigger action to activate a direct, simple reciprocal pump action with a single squirt for each trigger pull. Other, more current water guns involve pressurized tanks with continuous shot capabilities. The following patents are representative of more recently developed water guns:

U.S. Pat. No. 5,074,437 to D'Andrade et al. is directed toward a toy water gun which is operated by selectively releasing water from a water reservoir that is pressurized with air. It is a one piece device formed in the general shape of a gun that has a manually operated air pump incorporated into the design. The air pump pressurizes a water reservoir and consequently pressurizes any water found therein. The pressurized water has an avenue of release that is regulated by the trigger mechanism of the invention. When no force is applied to the trigger, the pressurized water is held in the pressurized container with no means of release. When force is applied to the trigger, water is released from the pressurized container and is channeled through a narrow nozzle. The escape of the pressurized water through the narrow nozzle creates a stream of propelled water that lasts as long as the trigger is engaged or until the pressure of the water in the pressurized container equals ambient pressure.

U.S. Pat. No. 5,322,191 to Johnson et al. describes a toy water gun having a housing with extended handle, a release mechanism and barrel. The water gun is connected to at least one water source external from and connected to the housing. In preferred embodiments, the water source is remote and has an indirect connection, e.g. by tubing or hosing, external of said housing and having a vent to surrounding ambient air so air may enter therethrough. Also included is a pressurized air and water storage tank external from and connectable to the housing. The pressurized tank has an orifice between said pressurized tank and said housing through which all liquids and gasses pass. There is also a pumping means for withdrawing air or water from the source or sources, and for depositing the withdrawn air or water into the pressurized tank. A plurality of one-way flow valves is included wherein at least one one-way flow valve prohibits water and air from flowing from the pressurized tank to the pumping means, at least another one said one-way flow valve prohibits water and air from flowing from the pumping means to the source or sources of air and water. There is a nozzle with a wide orifice therethrough, which is affixed to the end of said barrel, and an avenue of release connecting the nozzle to the pressurized tank. There is also a controlling means for regulating the flow of water and air through the avenue of release, the controlling means being actuatable by a release mechanism.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 5,529,525 to Deal describes a toy water bomb-mounted water gun. By the attachment of the water bomb device to a toy gun the present invention provides new functionality of the toy gun by being able to simulate a water "explosion". The water bomb device has a main housing which includes a frontward and rearward portion rotatably connected to one another and a passageway through both the frontward and rearward portions for receiving a shut off valve. The shut off valve is located within the housing and connected to both the frontward and rearward portions and adapted so that when the frontward and rearward portions are rotated relative to one another, the shut off valve is moved from an open position to a closed position. A locking mechanism releasably connects the frontward and rearward portions, such that rotation of the frontward portion relative to the rearward portion will close the shut off valve and the locking mechanism may then hold the shut off valve in its closed position until subsequently release by a trigger. An expandable bladder is filled with liquid and expends liquid when the device is activated and the shut off valve is opened.

Notwithstanding the prior art, the present invention is neither taught nor rendered obvious thereby.

SUMMARY OF THE INVENTION

In a toy water gun having a barrel and a water ejection nozzle connected to an end of the barrel, wherein the nozzle has an ejection orifice of a predetermined diameter, there is included in the barrel a turbulence control member in proximity to the nozzle. This is for enhanced laminar flow ejection through the nozzle. The turbulence control member has a plurality of linear stream guidance walls. In some embodiments, optional screen(s) are included which are located contiguous to an end or both ends of the turbulence control member.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
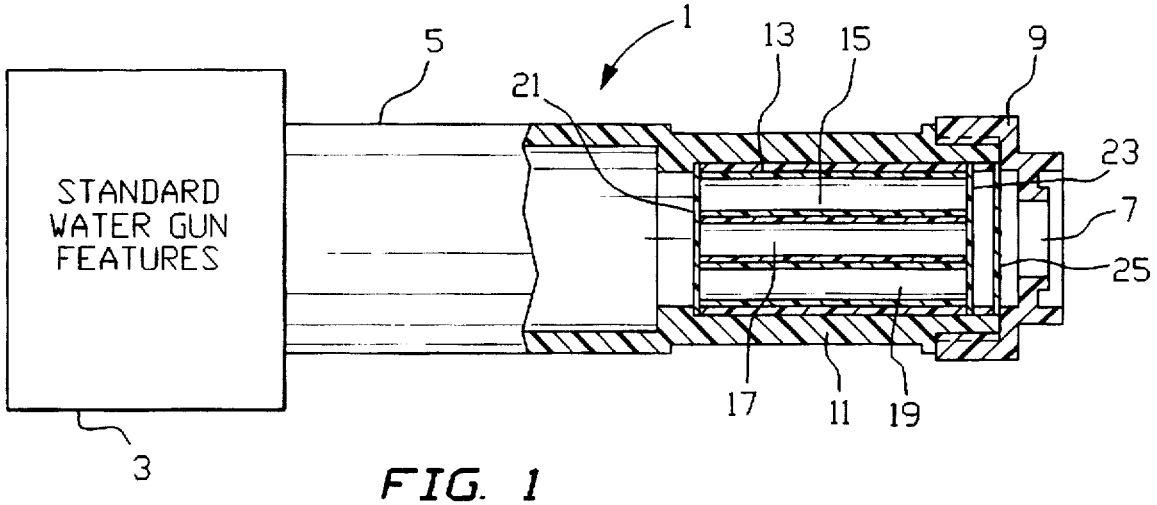
FIG. 1 illustrates a side cut view of a present invention device illustrating one embodiment showing a turbulence control member.

FIG. 1 shows a side cut view of a water gun designated generally as water gun 1 and the main aspects of the water gun are shown in schematic illustration as standard water gun features 3. Standard water gun features would include all aspects of a water gun with the exception of a barrel and nozzle. Thus, any standard water gun could be utilized in conjunction with the improved nozzle of the present invention. These would include pump up water guns such as is described in the information disclosure statement above, bladder water guns, reciprocal firing water guns, and any other water guns which are or may be available.

Also shown in FIG. 1 is barrel 5 with large diameter nozzle 7 contained in nozzle cover 9. Barrel 5 has a front section 11 which is specifically designed to receive a turbulence control member 13. Turbulence control member 13 is shown in its cut side view and has a bundle of tubes such as tubes 15, 17, and 19 which run parallel to the elongated length of barrel 5 and act as linear stream guidance walls. This enhances laminar flow ejection of water through nozzle 7. Further enhancement is achieved by the optional use of screens such as screen 21 placed against the rearward end of turbulence control member 13, screen 23 placed against the front end of turbulence control member 13, and screen 25 spaced away from screen 23 in front of turbulence control member 13 and against nozzle cover 9, as shown.

Figure 2:
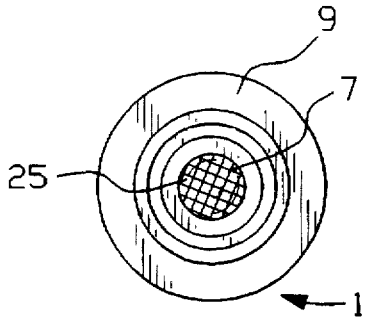
FIG. 2 shows a front view of the nozzle shown in FIG. 1.

FIG. 2 shows a front view of the nozzle shown in FIG. 1. Nozzle 7 contained in nozzle cover 9 reveals behind it screen 25, as shown.

Figure 3:
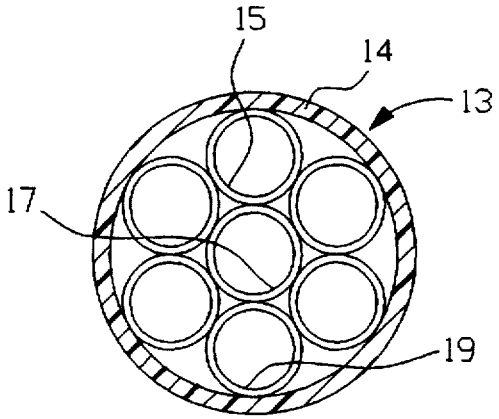
FIG. 3 shows a front cut view of the turbulence control member shown in FIG. 1.

Referring now to FIG. 3, there is shown an enlarged cross-sectional view of the turbulence control member 13 shown in FIG. 1. Thus, turbulence control member 13 has an outer hollow tube 14 and contains a plurality of hollow, elongated, parallel tubes such as tubes 15, 17, and 19.

Figure 4:
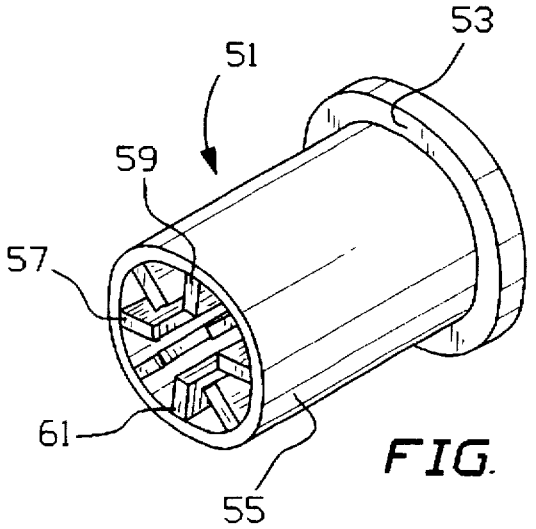
FIG. 4 shows an oblique view of an alternative turbulence control member for present invention toy water gun having internal linear stream guidance walls.

Referring now to FIG. 4, there is shown another embodiment of a turbulence control member 51. This is unistructurally formed and includes a flanged front section 53 which may include a nozzle orifice or may be placed within a similarly structured barrel to that described in connection with the first embodiment with a nozzle cover located in front of it. Additionally, optional screens may be included in front of, behind, or both in front of and behind turbulence control member 51. Elongated portion 55 has been formed with a plurality of linear stream guidance walls such as walls 57, 59, and 61, along with others, as shown. These linear stream guidance walls project radially inwardly and run parallel to an imaginary central axis for maximum turbulence control.

While the linear stream guidance walls shown in FIG. 4 are linear and project inwardly toward a central axis, and the linear stream guidance walls of FIG. 3 are comprised of tubes, any reasonable geometry will aid in turbulence control as long as the linear stream guidance walls generally run substantially parallel to the central axis of the barrel to settle the flow of liquid to substantially reduce turbulence. This permits a more laminar slug of water to exit the nozzle, which in turn keeps the water together for a longer shooting distance. Thus, the particular geometry selected may now come within the purview of the artisan.

Figure 5:
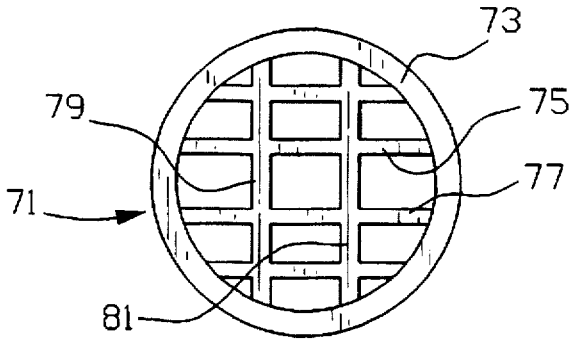
FIG. 5 shows a front view of another alternative embodiment turbulence control member with a plurality of fins having a predetermined geometric pattern; and, FIG. 6 shows an oblique view of yet another alternative embodiment turbulence control member having external linear stream guidance walls.

For example, FIG. 5 illustrates a front view of a turbulence control member 71 with a plurality of fins acting as linear stream guidance walls. It includes an elongated outer tube 73 and parallel fins represented by fins 75 and 77 and fins arranged at right angles thereto shown as fins 79 and 81. These fins all run parallel to the elongated outer tube 73.

Figure 6:
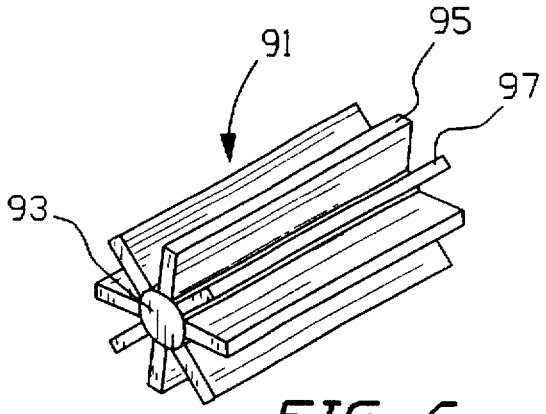

Likewise, FIG. 6 shows turbulence control member 91 which may be unistructurally formed and has a central core 93 with outwardly extending radial fins such as fins 95 and 97, as shown. The Figure is exaggerated with regard to the thickness of central core 93 and turbulence control member 91 may ideally be unistructurally formed and may optionally be used with one or more screens and inserted into a water gun barrel in proximity to the nozzle.

Obviously, numerous modifications and variations of the present invention are possible in light of the above teachings. It is therefore understood that within the scope of the appended claims, the invention may be practiced otherwise than as specifically described herein.

What is claimed is:

1. A toy water gun which comprises:

a hand held portable toy water gun having a barrel defined by an elongated portion having a central axis and a water ejection nozzle connected to an end of said barrel, said nozzle having an ejection orifice of a predetermined diameter, said barrel including:

a separate insertable elongated turbulence control member located in said barrel of said portable toy water gun in proximity to said nozzle for enhanced laminar flow ejection of a liquid through said nozzle such that said turbulence control member is capable of emitting a high velocity stream of liquid therefrom, said turbulence control member having a plurality of separate linear, tubular stream guidance walls, said linear, tubular stream guidance walls extending substantially parallel to the central axis of said elongated portion of said barrel, wherein at least one of said tubular guidance walls is centrally located within said turbulence control member; and at least one screen contiguous to an end of said turbulence control member.

2. The toy water gun of claim 1 which includes at least 2 screens, at least one screen being located at each end of said turbulence control member.

3. The toy water gun of claim 1 wherein said insertable turbulence control member is an elongated tubular member adapted to fit within said barrel, said elongated tubular member having contained therein a plurality of smaller elongated tubular members which establish said linear tubular stream guidance walls.

4. The toy water gun of claim 3 which includes at least 2 screens, at least one screen being located at each end of said turbulence control member.

5. A toy water gun which comprises:

a hand held portable toy water gun having a barrel defined by an elongated portion having a central axis and a water ejection nozzle connected to an end of said barrel, said nozzle having an ejection orifice of a predetermined diameter, said barrel having a turbulence control member which consists of:

a separate insertable elongated turbulence control member located in said barrel of said portable toy water gun in proximity to said nozzle for enhanced laminar flow ejection of a liquid through said nozzle, said turbulence control member being capable of emitting a high velocity stream of liquid therefrom, said turbulence control member having a plurality of separate linear, tubular stream guidance walls, said linear, tubular stream guidance walls extending substantially parallel to the central axis of said elongated portion of said barrel, wherein at least one of said tubular guidance walls is centrally located within said turbulence control member; and at least one screen contiguous to an end of said turbulence control member.

6. The toy water gun of claim 5 which includes at least 2 screens, at least one screen being located at each end of said turbulence control member.

7. The toy water gun of claim 5 wherein said insertable turbulence control member is an elongated tubular member adapted to fit within said barrel, said elongated tubular member having contained therein a plurality of smaller elongated tubular members which establish said linear tubular stream guidance walls.

8. The toy water gun of claim 7 which includes at least 2 screens, at least one screen being located at each end of said turbulence control member.

9. A portable hand held toy water gun, said portable hand held water gun having a barrel defined by an elongated portion having a central axis and a water ejection nozzle connected to an end of said barrel, said nozzle having an ejection orifice of a predetermined diameter, said barrel having a turbulence control member, said turbulence control member comprising:

a separate elongated turbulence control member insert located in said barrel of said portable toy water gun in proximity to said nozzle for enhanced laminar flow ejection of a liquid through said nozzle, said turbulence control member insert being capable of emitting a high velocity stream of liquid therefrom, said turbulence control member having a plurality of separate linear, tubular stream guidance walls, said separate linear, tubular stream guidance walls extending substantially parallel to the central axis of said elongated portion of said barrel, wherein at least one of said tubular guidance walls is centrally located within said turbulence control member insert; and at least one screen contiguous to an end of said turbulence control member insert.

10. The toy water gun of claim 9 which includes at least 2 screens, at least one screen being located at each end of said turbulence control member insert.

11. The toy water gun of claim 9 wherein said turbulence control member insert is an elongated tubular member adapted to fit within said barrel, said elongated tubular member having contained therein a plurality of smaller elongated tubular members which establish said linear tubular stream guidance walls.

12. The toy water gun of claim 11 which includes at least 2 screens, at least one screen being located at each end of said turbulence control member insert.

* * * * *